US006536150B2

(12) United States Patent
Schweikart

(10) Patent No.: US 6,536,150 B2
(45) Date of Patent: Mar. 25, 2003

(54) AUTOMATIC FIREARM WITH A MOVING BOLT ASSEMBLY WITH LOCKING PROJECTIONS

(75) Inventor: Thomas Schweikart, Messkirch (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/917,548

(22) Filed: Jul. 27, 2001

(65) Prior Publication Data

US 2002/0073591 A1 Jun. 20, 2002

Related U.S. Application Data

(63) Continuation of application No. PCT/EP00/00644, filed on Jan. 27, 2000.

(30) Foreign Application Priority Data

Jan. 28, 1999 (DE) ..... 199 03 322

(51) Int. Cl.[7] ..... F41A 3/00

(52) U.S. Cl. ..... 42/16; 42/25; 89/185

(58) Field of Search ..... 42/16, 25; 89/185

(56) References Cited

U.S. PATENT DOCUMENTS

| | | | | |
|---|---|---|---|---|
| 2,481,548 A | | 9/1949 | Waltke | |
| 2,967,367 A | | 1/1961 | Ivy | 42/16 |
| 3,341,963 A | | 9/1967 | Seiderman | |
| 3,791,060 A | | 2/1974 | Weaver | 42/16 |
| 3,791,256 A | | 2/1974 | Curtis et al. | 89/185 |
| 3,807,075 A | | 4/1974 | Mylonas | 42/98 |
| 3,882,625 A | | 5/1975 | Iellie | 42/25 |
| 3,906,651 A | * | 9/1975 | Vesamaa | 42/25 |

FOREIGN PATENT DOCUMENTS

| | | |
|---|---|---|
| CH | 580 269 | 9/1976 |
| DE | 501266 C | 2/1930 |
| DE | 1858576 | 9/1962 |
| DE | 2 402 445 | 1/1974 |
| DE | 2443044 | 9/1974 |
| DE | 28 12 732 | 6/1979 |
| DE | 32 44 315 A1 | 5/1984 |
| FR | 2215600 | 1/1973 |

OTHER PUBLICATIONS

International Search Report corresponding to International Patent Application Serial No. PCT/EP00/00520, dated May 26, 2000, 3 pages.

International Preliminary Examintion Report corresponding to International Patent Application Serial No. PCT/EP00/00520, dated Aug. 13, 2001, 5 pages.

*International Search Report* corresponding to International Patent Application Serial No. PCT/EP00/00551, dated May 19, 2000, 4 pages.

*International Preliminary Examination Report* corresponding to International Patent Application Serial No. PCT/EP00/00551, dated Aug. 13, 2001, 5 pages.

*International Search Report* corresponding to International Patent Application Serial No. PCT/EP00/00644, dated May 19, 2000, 4 pages.

*Primary Examiner*—Michael J. Carone
*Assistant Examiner*—M Thomson
(74) *Attorney, Agent, or Firm*—Marshall, Gerstein & Borun

(57) ABSTRACT

The bolt assembly includes a bolt head having a locked position and an unlocked position. The bolt head also has a periphery and an even number of arrangement sites located on the periphery. The bolt assembly further includes a plurality of locking projections positioned at a subset of the arrangement sites on the periphery of the bolt head. It also includes a cartridge extractor disposed at one of the arrangement sites which is not part of the subset and which is located horizontally adjacent the central longitudinal axis of the barrel when the bolt head is in the unlocked position.

(List continued on next page.)

18 Claims, 2 Drawing Sheets

U.S. PATENT DOCUMENTS

| | | | | | |
|---|---|---|---|---|---|
| 3,969,983 | A | | 7/1976 | Zellweger | 89/185 |
| 3,999,318 | A | * | 12/1976 | Tellie | 42/1 |
| 4,020,577 | A | | 5/1977 | Duffy | 42/16 |
| 4,191,089 | A | | 3/1980 | Zedrosser | 89/181 |
| 4,272,902 | A | | 6/1981 | Waters | 42/25 |
| 4,328,737 | A | * | 5/1982 | Nelson et al. | 89/33 |
| 4,481,858 | A | * | 11/1984 | Price | 89/11 |
| 4,562,659 | A | * | 1/1986 | Neta | 42/75 |
| 4,563,937 | A | * | 1/1986 | White | 89/185 |
| 4,635,530 | A | | 1/1987 | Welde | 89/159 |
| 4,644,930 | A | | 2/1987 | Mainhardt | 124/58 |
| 4,676,017 | A | | 6/1987 | Hurlemann et al. | 42/25 |
| 4,691,615 | A | * | 9/1987 | Brunton | 89/33.4 |
| 5,285,593 | A | | 2/1994 | Bammate | 42/98 |
| 5,499,569 | A | * | 3/1996 | Schuetz | 89/197 |
| 5,821,445 | A | | 10/1998 | Guhring | 89/1.42 |
| 6,000,161 | A | * | 12/1999 | Aalto | 42/16 |
| 6,044,748 | A | * | 4/2000 | Westrom | 89/185 |
| 6,101,919 | A | * | 8/2000 | Murello | 89/188 |
| 6,314,672 | B2 | | 11/2001 | Murello et al. | 42/124 |

* cited by examiner

AUTOMATIC FIREARM WITH A MOVING BOLT ASSEMBLY WITH LOCKING PROJECTIONS

RELATED APPLICATION

This application is a continuation of and claims priority under 35 U.S.C. § 120 from PCT Application Serial No. PCT/EP00/00644, filed Jan. 27, 2000.

FIELD OF INVENTION

The present invention relates generally to firearms, and more particularly, to locking projections on a moving bolt assembly of a firearm for alternately changing the direction of cartridge ejection from the firearm.

BACKGROUND OF THE INVENTION

Direction and position references made in this patent such as "horizontal," "forward," "leftward," and "rightward" assume that the firearm is in the normal firing position, where the bore axis of the barrel (i.e., the center longitudinal axis) is horizontal and shooting is in the forward direction away from the shooter.

A firearm of the general type of interest here is known from CH 580 269 A. Similar weapons also known from DE 24 42 044 and U.S. Pat. No. 2 481 548 A.

CH 580 269 shows a bolt assembly capable of converting the direction of cartridge ejection, but with an odd number of arrangement sites. DE 24 43 044 shows a bolt head with ten locking projections. However, it is not apparent where the cartridge extractor is placed on the weapon.

SUMMARY OF THE INVENTION

In accordance with an aspect of the invention, a bolt assembly is provided for use with a firearm having a barrel with a central longitudinal axis and a magazine for receiving cartridges. The bolt assembly includes a bolt head having a locked position and an unlocked position. The bolt head also has a periphery and an even number of arrangement sites located on the periphery. The bolt assembly further includes a plurality of locking projections positioned at a subset of the arrangement sites on the periphery of the bolt head. It also includes a cartridge extractor disposed at one of the arrangement sites which is not part of the subset and which is located horizontally adjacent the central longitudinal axis of the barrel when the bolt head is in the unlocked position.

DESCRIPTION OF THE PREFERRED EMBODIMENT

This type of weapon is also described in U.S. patent application Ser. No. 09/911,008 which is hereby incorporated by reference in its entirety.

The weapon described in U.S. application Ser. No. 09/911,008 has a bolt assembly with a bolt head that can be positioned in one of at least two assembly positions. Because of this capability, the weapon can alternately eject cartridge casings rightward or leftward. Left-handed shooters can optimally operate such a weapon according to their aptitude. For adjustment of such a weapon between leftward and rightward cartridge ejection modes, it is only necessary to properly position the bolt head in the appropriate assembly position.

This type of bolt head has a number of arrangement sites around its periphery, on which radially running protrusions, (the so-called locking projections), are positioned. The arrangement sites are ordinarily uniformly distributed, (i.e., they have the same angular spacing), referenced to the longitudinal center axis of the barrel and bolt assembly. During closure of the bolt assembly, the locking projections enter complementary, fixed longitudinal grooves, pass through these grooves, and then finally engage behind these grooves as a result of rotation of the bolt head around its longitudinal center axis. This rotation covers an angle amounting to about half the aforementioned angular spacing and is called the locking angle.

To increase firing accuracy, as many such locking projections as possible should be provided and arranged as pole-symmetrically as possible relative to the longitudinal center axis.

However, on the periphery of the front end of the bolt head, a cartridge extractor is mounted. This extractor follows the rotation of the bolt head. The bolt head must, therefore, be lengthened (ideally in front of the locking projections), in order to be able to accommodate the cartridge extractor without adversely affecting the arrangement of the locking projection that increases firing accuracy. This type of lengthening of the bolt head, however, runs counter to efforts to design the weapon as short as possible. It would also be possible to increase the radial spacing of the locking projection from the longitudinal center axis, but this would increase the likelihood of jamming the weapon.

Figure 1:
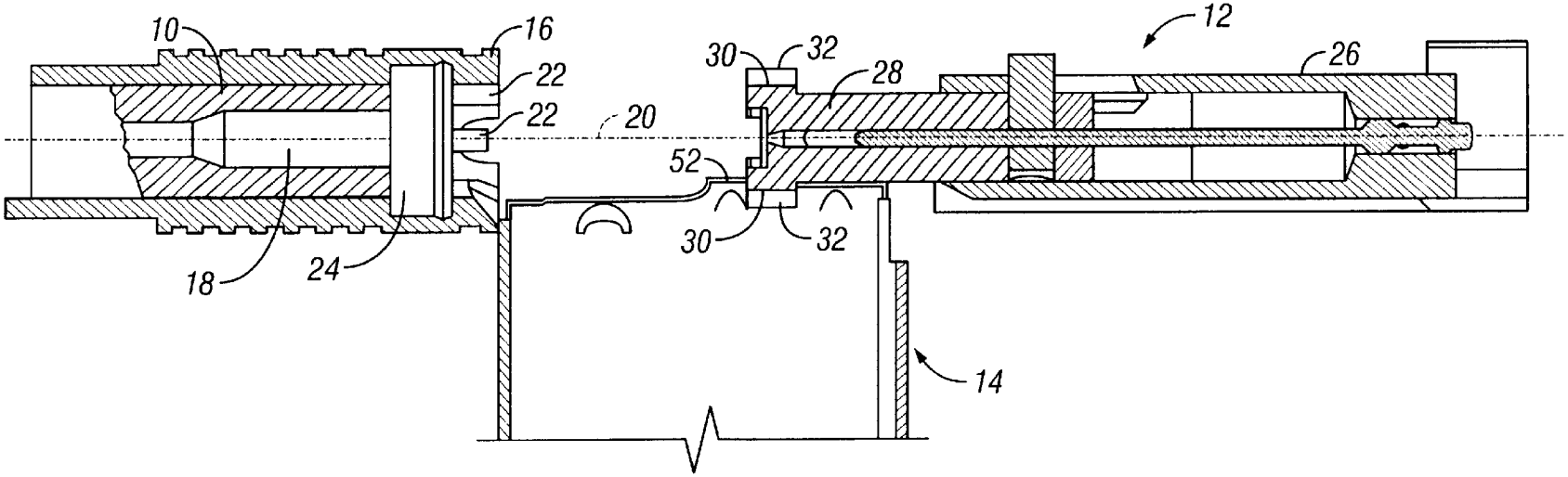
FIG. 1 is a sectional elevational view of an example barrel, bolt assembly and magazine of a rapid fire firearm constructed in accordance with the teachings of the invention.
Figure 2:
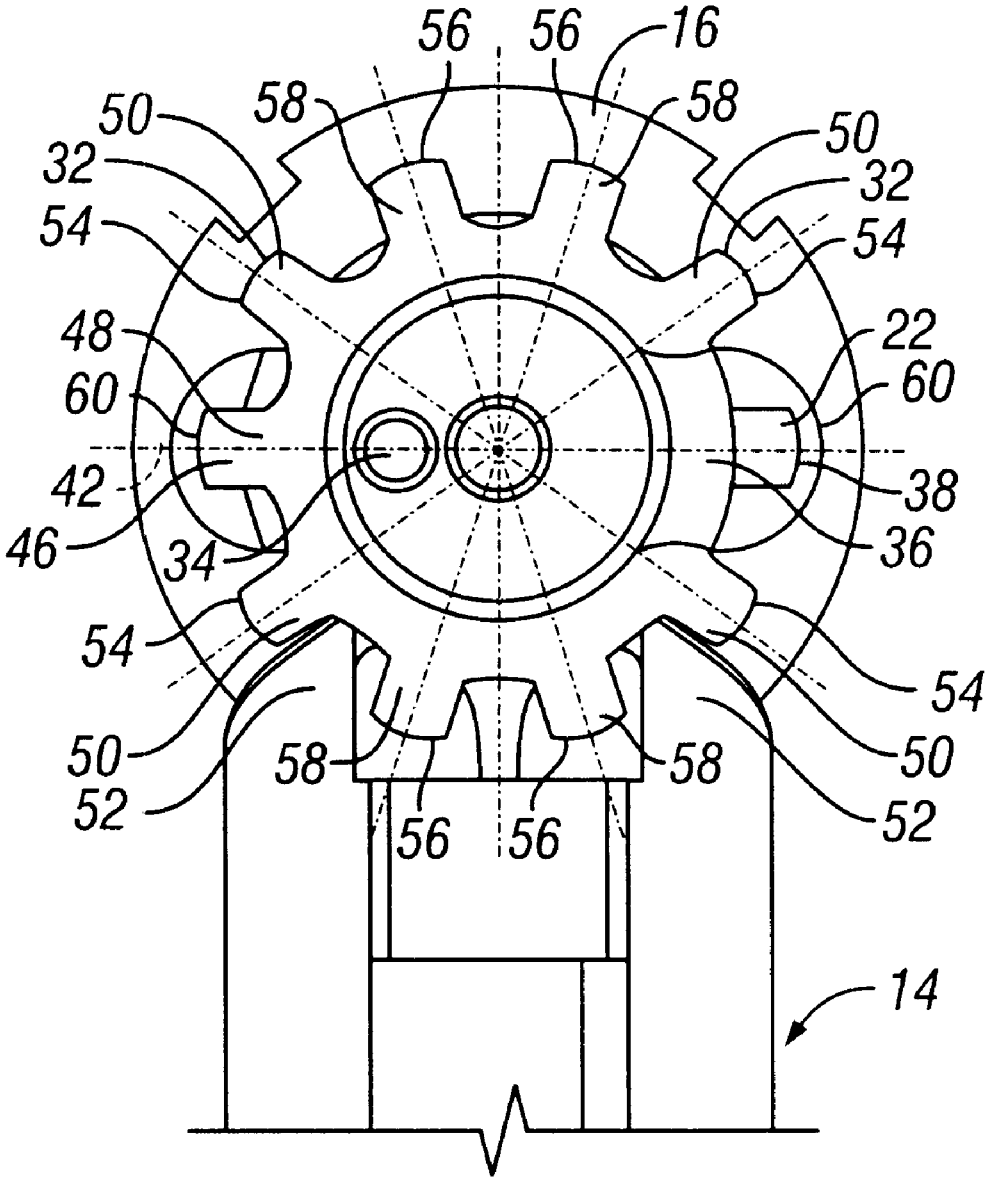
FIG. 2 is a front sectional view of the firearm shown in FIG. 1.

The firearm disclosed herein as shown partially by FIGS. 1 and 2, includes a barrel 10, a bolt assembly 12 and a magazine 14.

The rear end of barrel 10 sits against a bushing 16 that is firmly anchored in the housing of the disclosed firearm (not shown). The aft portion of barrel 10 includes a cartridge chamber 18. A reference longitudinal center axis 20 of the disclosed firearm is defined by the longitudinal axis of the bore of the barrel 10.

A number of longitudinal grooves 22 are radially disposed at the rear end of bushing 16. The grooves open to an annular recess 24, which abuts cartridge chamber 18.

Bolt assembly 12 can be moved along longitudinal center axis 20. Bolt assembly 12 includes a bolt carrier 26 and a bolt head 28 mounted on bolt carrier 26. Bolt head 28 is rotatable and longitudinally movable on bolt carrier 26.

Preferably ten arrangement sites 30 are positioned radially on the front periphery of bolt head 28. The positions of the arrangement sites 30 correspond to the radial positions of grooves 22. As shown in FIG. 2, a locking projection 32 is arranged on each of nine of the arrangement sites 30, and a cartridge ejector 34 in the form of an extractor claw 36 is arranged on the tenth arrangement site 38. The ejector 34 is positioned in bolt head 28 opposite extractor claw 36 (see FIG. 1).

Magazine 14 includes two magazine lips 52 on top thereof, which hold the cartridges (not shown) from advancing up and outside magazine 14. The cartridges lie in magazine 14 in a zigzag arrangement so that they are alternately held inside magazine 14 by one of the magazine lips 52.

The ten arrangement sites 30 for locking projections 32 and extractor claw 36 are symmetrically arranged relative to each other and relative to a horizontal axis 42, which is the lateral central axis of the bore of barrel 10. Arrangement site 38 for extractor claw 36, and the horizontally opposite arrangement site 48, which includes a locking projection 46 lie on horizontal axis 42. Each of horizontal arrangement sites 38 and 48 is followed upwardly and downwardly by adjacent arrangement sites 50. The two downwardly located arrangement sites 50 are so arranged that magazine lips 52 fit between two locking projections 54 at these arrangement sites and the next downwardly locking projections 56. The two locking projections 56 on both of the lowermost arrangement sites 58 are positioned so that one of the locking projections 58 can alternately engage the center rear portion of the upper most cartridge (not shown) in magazine 14.

Bolt head 28 travels over magazine 14 when bolt assembly 12 is opened. The cartridges in magazine 14 advance upward as soon as bolt head 28 clears the top of magazine 14. During subsequent closing of bolt assembly 12, the uppermost cartridge is pushed into cartridge chamber 18 by one of the lowermost locking projections 56.

During the closing of bolt assembly 12, each of the nine locking projections 32 precisely aligns with a respective corresponding groove 22. One of the horizontal grooves 22 just forward of extractor claw 36, however, remains free because there is no locking projection 32 at the location of extractor claw 36. Bolt head 28 can be located in two different positions, one where extractor claw 36 is on the left side of bolt head 28 and the other where extractor claw 36 is on the right side of bolt head 28. In both positions, however, extractor claw 36 will be aligned with horizontal axis 28. Each of the two horizontal grooves 22 has an outwardly expanded entry 60 that can press against extractor claw 36 during closing of bolt assembly 12.

Locking projections 32 pass through grooves 22 and enter annular recess 24 when bolt assembly reaches cartridge chamber 18. The closure of bolt assembly 12 is completed by rotating the bolt head 28 of the bolt assembly 12 so that the locking projections 32 engage the connecting surfaces between grooves 22. The recoil occurring during a shot is therefore fully introduced into bushing 16 and into the weapon housing through the connecting surfaces.

The above description of the disclosed firearm is only an example and in no way limiting the teachings of this disclosure. Arrangement sites 30 could also be distributed differently on the periphery of bolt head 28, for example, with the same angular spacing. The distribution of arrangement sites 30 could also be adapted to any magazine and is not limited to the for the U.S. M16 weapon.

The disclosed firearm can be adapted for use with any appropriate cartridge and is not limited to the 0.223 Remington cartridge.

From the foregoing, persons of ordinary skill in the art will appreciate that the disclosed firearm is an automatic firearm with a cartridge extractor 36 that rotates with the rotation of the bolt assembly 12, where the aforementioned problem of requiring a large number of locking projections 32 for high firing accuracy, and problems associated with placement of both the cartridge extractor 36 and the locking projections 32, are solved in the most advantageous manner possible.

The disclosed firearm has an even number of arrangement sites 30 on the periphery of the bolt head. A locking projection 32 on one of the arrangement sites 38 is replaced with the cartridge extractor 36. The arrangement site 38 where the cartridge extractor 36 is placed is one which is situated horizontally and aligned with the barrel axis when the bolt assembly 12 is unlocked.

The two aforementioned features of the disclosed firearm are causally linked.

In assembly positions of the bolt assembly 12, (i.e., the positions for use by right handed or left handed shooters), the two alternate positions of the cartridge extractor36 are diametrically opposite each other. Thus, cartridge ejection occurs horizontally in each assembly position. Horizontal cartridge ejection allows mounting of bulky detection and aiming devices above the firearm (e.g., night sighting devices with infrared emitter). Furthermore, an enemy cannot see horizontally ejected cartridge casings as well as those ejected vertically or obliquely upward. Additionally, vertically ejected cartridges may reflect sunlight and cause detection of the shooter, or can be detected at night by an infrared observation device. Thus, for horizontal placement of the cartridge extractor 36, an even number of arrangement sites 30 is necessary so that an odd number of locking projections 32 are produced.

In the disclosed firearm, the absence of a locking projection 32 where cartridge casings are ejected does not have a significant effect on the performance of the firearm. Experiments have shown that the absence of a locking projection 32 does not have a significant adverse effect on the shooting performance required of an ordinary automatic firearm.

As discussed, the cartridge extractor 36 occupies a horizontal arrangement site only when the bolt assembly is unlocked. During locking, however, the cartridge extractor 36 is turned with the locking projections 32 by approximately half the angular space between the arrangement sites 30.

In principle, four arrangement sites 30 would be sufficient. With four arrangement sites 30, however, a locking projection 32 would be on the bottom of the bolt head during the return of the bolt assembly 12 and would grasp the rear of the bottom of the uppermost cartridge in the magazine during the advance of the bolt assembly 12. A natural requirement for such firearms as the one disclosed here is that the magazine be designed as a clip magazine protruding downward from the firearm, or as a magazine that advances the cartridges in similar fashion from the bottom center, such as a rotary magazine.

In magazines, in which the cartridges are arranged in a single row, the uppermost cartridge is engaged in the center. However, with the zigzag arrangement of cartridges in magazines that are common today, the uppermost cartridge is engaged off-center. Under certain circumstances, a downward locking projection 32 that extends vertically downward into the magazine would pose the hazard of grazing the next cartridge because the locking projection 32, which extends vertically downward reaches far into the magazine.

To eliminate the aforementioned hazard and improve the reloading characteristics of the firearm, it is expedient to pass two locking projections 56 between the magazine lips 52. The two locking projections 56 are positioned on both sides of the vertical longitudinal center plane of the firearm and are slightly sloped related to the plane. In a magazine with a zigzag cartridge arrangement, one of the locking projections 56 grasps the uppermost cartridge in the center, and the other locking projection 56 moves freely over the second cartridge because it lies significantly deeper than the uppermost cartridge. In zigzag type magazines, the uppermost cartridge is only held in place by one of the two magazine lips and by the next cartridge.

In the disclosed firearm, advance of the uppermost cartridge is thus improved because it is always grasped in the center by one of the two obliquely lying locking projections 56. Furthermore, the hazard of random engagement of the next cartridge is eliminated because the lower edge of the other obliquely lying locking projections 56 lies well above the next cartridge.

In order to achieve the aforementioned advantageous positions of the locking projections 32, a number of arrangement sites 30 that is even and opposite each other in pairs is required. A further requirement is that the number of arrangement sites 30 cannot be divisible by four so that the arrangement sites 30 are not offset relative to each other by 90 degrees.

The proposition of ideally having as many locking projections 32 as possible runs counter to the problem of contamination in an unduly open design. Ten arrangement sites 30 on the bolt head 28 have been proven optimal. With ten arrangement sites 30, even mass produced magazines of other manufacturers can be used for the disclosed firearm, since it is not necessary to also optimize the magazine after optimization of the bolt assembly advance process.

As already discussed in the foregoing, longitudinal grooves 22 parallel to the longitudinal axis 20 of the firearm and corresponding to each locking projection 32 are provided on the aft portion of the cartridge chamber 18. The longitudinal grooves 22 start from a radial recess, through which the bolt head 28 passes during opening and closing of the bolt assembly 12. Directly behind the cartridge chamber 18 an annular recess 24 is provided, into which the longitudinal grooves 22 enter.

The axial length of the annular recess 24 approximately corresponds to the axial length of the locking projections 32. When the bolt assembly 12 is closed, the locking projections 32 are positioned in the annular recess 24 and can be rotationally moved within the annular recess 24.

Preferably, the two horizontal longitudinal grooves 22 that are arranged on both sides of the longitudinal center axis 20 are neither widened nor deepened. A locking projection 46 is provided on the opposite side of the cartridge ejector 34 (see U.S. patent application Ser. No. 09/911,008). To avoid run-up of the cartridge ejector, each of the two horizontal longitudinal grooves 22 is beveled, against which the cartridge ejector runs smoothly to then be forced into its desired position.

As discussed earlier, the angular spacing between each arrangement site 30 should ideally be the same.

However, it has proven advantageous in the disclosed firearm to reduce the angular spacing between the bottommost arrangement sites 58, so that the bottom locking projections 56 are oriented optimally downward into the magazine. Owing to the two assembly positions of the bolt head 28 that are rotationally offset by 180 degrees, the angular spacing between the topmost locking projections 56 is also reduced. In other words, the topmost and bottommost locking projections 56 are mirror images of each other. Accordingly, the angular spacing between the two topmost and the two bottommost arrangement sites can be reduced to the width of one locking projection 32. The rotational movement of the bolt head 28 which locks the bolt assembly 12 then corresponds to half the angular spacing between the two uppermost or the two bottommost locking projections 56.

The arrangement sites 50 immediately adjacent the lowermost and uppermost locking projections 56 can be offset so that the magazine lips 52 sit in the angular space between the lowermost or uppermost locking projections 56 (depending on the orientation/assembly position of the bolt assembly) and the immediately adjacent locking projections 54. It is thus possible to fully adapt the disclosed firearm to available magazines by offsetting the locking projections, even though the dimensions of the constructed bolt assembly actually may always require a specific magazine.

As a result, replacing aged firearms with new ones in an army will preferably not pose compatibility problems with the firearms' magazines since the magazines of the old firearms can preferably be used with the new and vice versa.

With ten arrangement sites 30 and nine locking projections 32, a preferred angular spacing which has proven particularly advantages is as follows:

The angle between the center of the horizontal locking projection 46, or the cartridge ejector 34, to the center of the next locking projection 54 (so called projection "A" for clarity of explanation) is approximately 30 degrees. The center of the next locking projection 56 is set at 42 degrees from the previous locking projection "A." The magazine lip runs in the gap between the locking projections 54 and 56 that are 42 degrees apart. Finally, the two lowermost and the two uppermost locking projections 56 are each 36 degrees apart.

In an automatic firearm designed for the 0.223 caliber cartridge, and in which the ejection direction is horizontally rightward or leftward depending on the respective assembly position of the bolt head 38 as explained in U.S. application ser. No. 09/911,008, for example, the magazine of the U.S. M16 can be used.

Although certain apparatus constructed in accordance with the teachings of the invention have been described herein, the scope of coverage of this patent is not limited thereto. On the contrary, this patent covers all embodiments of the teachings of the invention falling within the scope of the appended claims either literally or under the doctrine of equivalents.

What is claimed is:

1. For use with a firearm having a barrel with a central longitudinal axis, and a magazine for receiving cartridges, a bolt assembly comprising:

a bolt head having a locked position and an unlocked position, the bolt head also having a periphery and an even number of arrangement sites located on the periphery;

a plurality of locking projections positioned at a subset of the arrangement sites on the periphery of the bolt head; and a cartridge extractor disposed at one of the arrangement sites which is not part of the subset and which is located horizontally adjacent the central longitudinal axis of the barrel when the bolt head is in the unlocked position;

wherein the arrangement sites are positioned so that the locking projections are run past two magazine lips during longitudinal movement of the bolt head.

2. A bolt assembly as defined in claim 1, wherein the number of arrangement sites is greater than four and is not divisible by four.

3. A bolt assembly as defined in claim 1, wherein the number of arrangement sites arranged on the periphery of the bolt head is ten.

4. A bolt assembly as defined in claim 1, wherein an angular spacing between the arrangement sites is unequal.

5. A bolt assembly as defined in claim 1, wherein two of the locking projections are positioned at a lowermost portion of the periphery of the bolt head and run between the two lips of the magazine.

6. A bolt assembly as defined in claim 5, wherein two projections on an uppermost periphery of the bolt head are positioned at locations which mirror the two projections positioned at the lowermost periphery of the bolt head.

7. For use with a firearm having a barrel with a central longitudinal axis, and a magazine for receiving cartridges, a bolt assembly comprising:

a bolt head having a locked position and an unlocked position, the bolt head also having a periphery and an even number of arrangement sites located on the periphery;

a plurality of locking projections positioned at a subset of the arrangement sites on the periphery of the bolt head; and a cartridge extractor disposed at one of the arrangement sites which is not part of the subset and which is located horizontally adjacent the central longitudinal axis of the barrel when the bolt head is in the unlocked position;

wherein the bolt head has a first assembly position for adapting the firearm to eject cartridges in a first direction and a second assembly position for adapting the firearm to eject cartridges in a second direction opposite the first direction.

8. A firearm comprising:

a barrel with a central longitudinal axis;

a magazine for receiving cartridges a bolt assembly including a bolt head having a locked position and an unlocked position, the bolt head also having a periphery and an even number of arrangement sites located on the periphery;

a plurality of locking projections positioned at a subset of the arrangement sites on the periphery of the bolt head; and a cartridge extractor disposed at one of the arrangement sites which is not part of the subset and which is located horizontally adjacent the central longitudinal axis of the barrel when the bolt head is in the unlocked position;

wherein the bolt head has a first assembly position for adapting the firearm to eject cartridges in a first direction and a second assembly position for adapting the firearm to eject cartridges in a second direction opposite the first direction.

9. A firearm as defined in claim 8, wherein the cartridge ejector is located horizontally adjacent the central longitudinal axis of the barrel when the bolt head is in the first assembly position and is located horizontally adjacent the central longitudinal axis of the barrel when the bolt head is in the second assembly position.

10. A firearm as defined in claim 8, wherein the number of arrangement sites is greater than four and is not divisible by four.

11. A firearm as defined in claim 8, wherein the number of arrangement sites arranged on the periphery of the bolt head is ten.

12. A firearm as defined in claim 8, wherein an angular spacing between the arrangement sites is unequal.

13. A firearm comprising:

a barrel with a central longitudinal axis;

a magazine for receiving cartridges a bolt assembly including a bolt head having a locked position and an unlocked position, the bolt head also having a periphery and an even number of arrangement sites located on the periphery;

a plurality of locking projections positioned at a subset of the arrangement sites on the periphery of the bolt head;

a cartridge extractor disposed at one of the arrangement sites which is not part of the subset and which is located horizontally adjacent the central longitudinal axis of the barrel when the bolt head is in the unlocked position; and a magazine having two magazine lips, wherein the arrangement sites are positioned so that the locking projections run past the two magazine lips during longitudinal movement of the bolt head.

14. A firearm as defined in claim 13, wherein two of the locking projections are positioned at a lowermost portion of the periphery of the bolt head and run between the two lips of the magazine.

15. A firearm as defined in claim 14, wherein two projections on an uppermost periphery of the bolt head are positioned at locations which mirror the two projections positioned at the lowermost periphery of the bolt head.

16. A firearm as defined in claim 13, wherein the magazine accommodates cartridges in a zigzag arrangement such that an uppermost cartridge in the magazine will be in one of two offset positions, wherein two of the locking positions run between the lips of the magazine, and wherein the two locking positions between the lips are each positioned to align with a respective one of the offset positions.

17. A firearm comprising:

a barrel with a central longitudinal axis;

a magazine for receiving cartridges a bolt assembly including a bolt head having a locked position and an unlocked position, the bolt head also having a periphery and an even number of arrangement sites located on the periphery;

a plurality of locking projections positioned at a subset of the arrangement sites on the periphery of the bolt head;

a cartridge extractor disposed at one of the arrangement sites which is not part of the subset and which is located horizontally adjacent the central longitudinal axis of the barrel when the bolt head is in the unlocked position; and a set of grooves defined in the barrel, the grooves in the set being positioned in alignment with the arrangement sites when the bolt head is in the unlocked position, wherein two of the grooves in the set are located horizontally adjacent the central longitudinal axis of the barrel, and each of the two grooves has a wider entry than the other grooves in the set.

18. A firearm as defined in claim 17, wherein the grooves are dimensioned for passage of the locking projections when the bolt head is in the unlocked position.

* * * * *